US006145607A

United States Patent [19]

Griffin et al.

[11] Patent Number: 6,145,607

[45] Date of Patent: Nov. 14, 2000

[54] PREFORM CUTTING ELEMENTS FOR ROTARY DRAG-TYPE DRILL BITS

[75] Inventors: Nigel Dennis Griffin, Whitminister; Terry R. Matthias, Leonards, both of United Kingdom

[73] Assignee: Camco International (UK) Limited, Stonehouse, United Kingdom

[21] Appl. No.: 09/184,607

[22] Filed: Nov. 2, 1998

[30] Foreign Application Priority Data

Sep. 24, 1998 [GB] United Kingdom ..... 9820693

[51] Int. Cl.[7] ..... E21B 10/36

[52] U.S. Cl. ..... 175/426; 175/428

[58] Field of Search ..... 175/426, 428, 175/432

[56] References Cited

U.S. PATENT DOCUMENTS

| | | | |
|---|---|---|---|
| 4,109,737 | 8/1978 | Bovenkerk | 175/430 |
| 4,764,434 | 8/1988 | Aronsson et al. | 428/565 |
| 5,351,772 | 10/1994 | Smith | 175/428 |
| 5,355,969 | 10/1994 | Hardy et al. | 175/432 |
| 5,379,854 | 1/1995 | Dennis | 175/434 |
| 5,435,403 | 7/1995 | Tibbitts | 175/432 |
| 5,472,376 | 12/1995 | Olmstead et al. | 451/540 |
| 5,564,511 | 10/1996 | Frushour | 175/431 |
| 5,590,729 | 1/1997 | Cooley et al. | 175/432 |
| 5,605,199 | 2/1997 | Newton | 175/432 |
| 5,645,617 | 7/1997 | Frushour | 51/309 |
| 5,669,271 | 9/1997 | Griffin et al. | 76/108.2 |
| 5,711,702 | 1/1998 | Devlin | 451/540 |
| 5,722,497 | 3/1998 | Gum et al. | 175/374 |
| 5,862,873 | 1/1999 | Matthias et al. | 175/432 |
| 5,887,580 | 3/1999 | Eyre | 125/36 |
| 5,971,087 | 10/1999 | Chaves | 175/432 |
| 5,979,579 | 11/1999 | Jurewicz | 175/434 |
| 6,003,623 | 12/1999 | Miess | 175/430 |
| 6,029,760 | 2/2000 | Hall | 175/432 |

FOREIGN PATENT DOCUMENTS

| | | |
|---|---|---|
| 2 316 698 | 3/1998 | United Kingdom . |
| 2 323 110 | 9/1998 | United Kingdom . |
| 2 335 681 | 9/1999 | United Kingdom . |

*Primary Examiner*—William Neuder
*Assistant Examiner*—Jennifer R Dougherty
*Attorney, Agent, or Firm*—Jeffrey E. Daly

[57] ABSTRACT

A preform cutting element, for a rotary drag-type drill bit, includes a facing table of polycrystalline diamond having a front face, a peripheral surface, and a rear surface bonded to the front surface of a tungsten carbide substrate. The facing table has at least one peripheral locking portion projecting rearwardly from the rear surface of the facing table into the substrate, the inner surface of the locking portion and the adjacent part of the substrate having interengaging formations whereby part of the substrate overlies at least one part of the locking portion. With this arrangement, forces acting on the facing table tending to lift it from the front surface of the substrate are resisted by the portion of the substrate which overlies the part of the locking portion.

27 Claims, 3 Drawing Sheets

FIG 3 (Prior art)
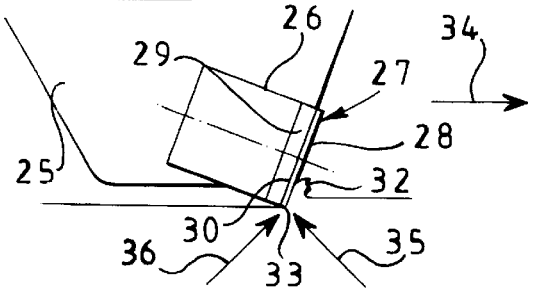
FIG 4
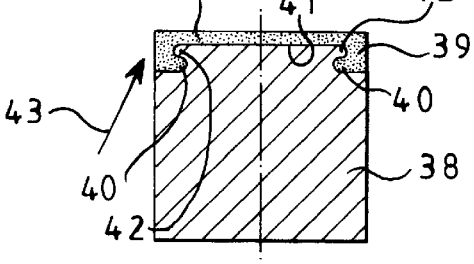
FIG 5
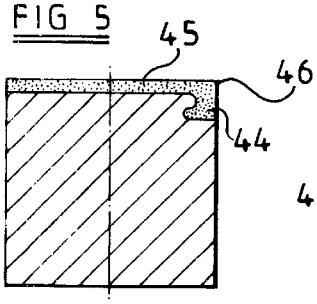
FIG 6
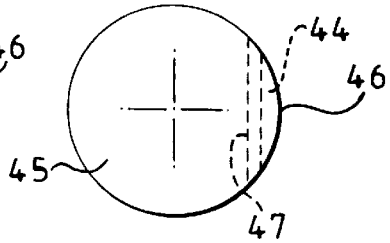
FIG 7
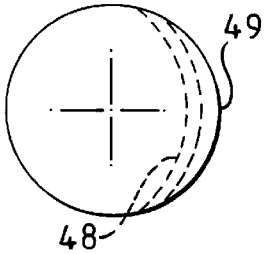
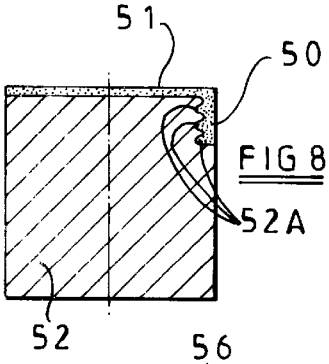
FIG 8
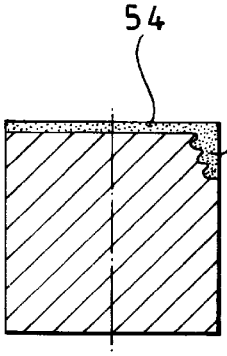
FIG 9
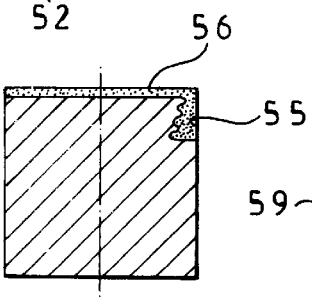
FIG 10
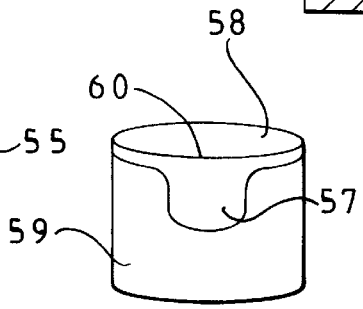
FIG 11
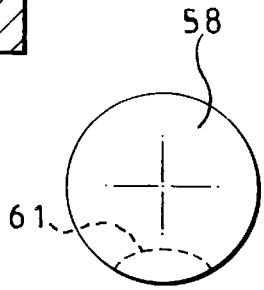
FIG 12
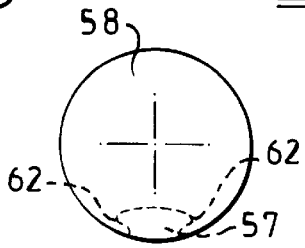
FIG 13

FIG 14
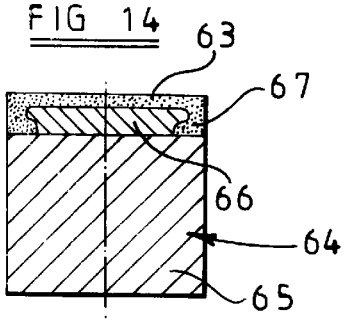
FIG 15
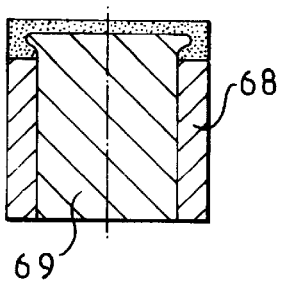
FIG 16
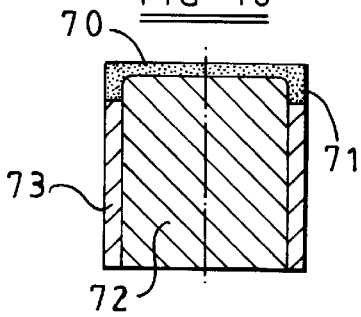
FIG 17
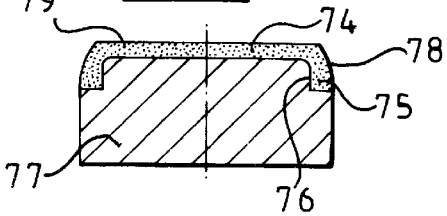
FIG 18
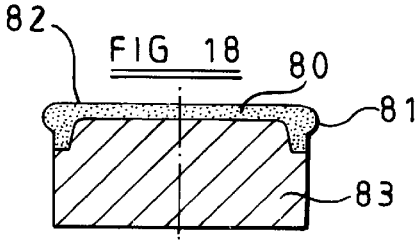
FIG 19
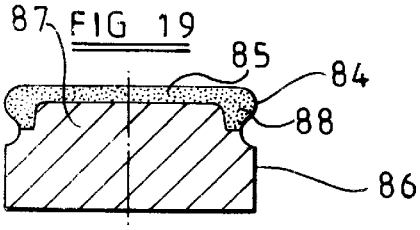
FIG 20
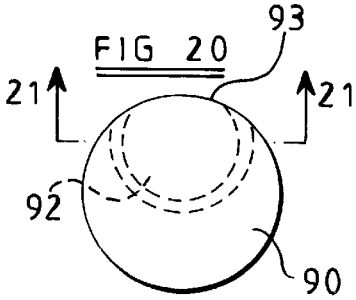
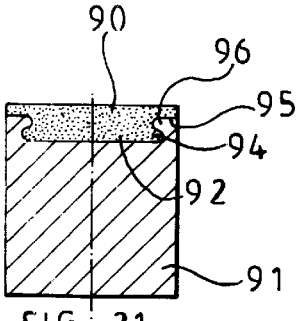
FIG 21
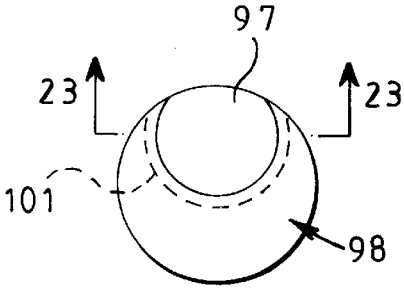
FIG 22
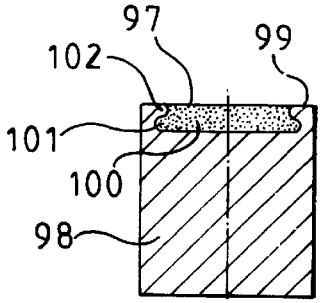
FIG 23
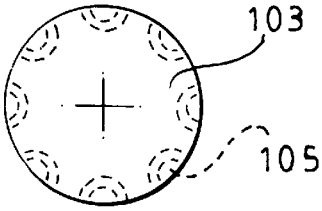
FIG 24
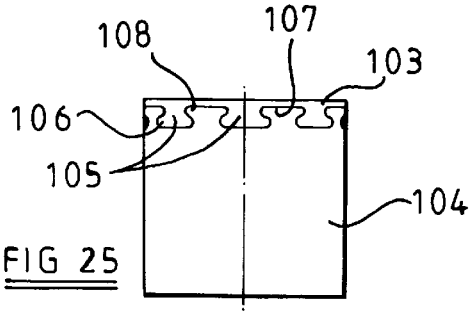
FIG 25

PREFORM CUTTING ELEMENTS FOR ROTARY DRAG-TYPE DRILL BITS

BACKGROUND OF THE INVENTION

1. Field of the Description

The invention relates to preform cutting elements for rotary drag-type drill bits, of the kind comprising a facing table of superhard material having a front face, a peripheral surface, and a rear surface bonded to the front surface of a substrate which is less hard than the facing table.

2. Description of Related Art

Such preform cutting elements usually have a facing table of polycrystalline diamond, although other superhard materials are available, such as cubic boron nitride. The substrate of less hard material is often formed from cemented tungsten carbide, and the facing table and substrate are bonded together during formation of the element in a high pressure, high temperature forming press. The forming process is well known and will not be described in detail.

Each preform cutting element may be mounted on a carrier in the form of a generally cylindrical stud or post received in a pocket in a body of the drill bit. The carrier is often formed from cemented tungsten carbide, the surface of the substrate being brazed to a surface on the carrier, for example by a process known as "LS bonding". Alternatively, the substrate itself may be of sufficient thickness to provide, in effect, a cylindrical stud which is sufficiently long to be directly received in a pocket in the bit body, without first being brazed to a carrier. The bit body itself may be machined from metal, usually steel, or may be molded using a powder metallurgy process.

In preform cutting elements of the above type the interface between the superhard table and the substrate may be flat and planar. However, the bond between the superhard facing table and the substrate may be improved by providing a configured non-planar interface between the rear face of the facing table and the front surface of the substrate, so as to provide a degree of mechanical interlocking between the facing table and substrate. It is also known to provide the rear surface of the facing table with an integral rearwardly extending peripheral rim which extends into a correspondingly shaped peripheral rebate in the substrate.

Such preform cutting elements are subjected to high temperatures and heavy loads when the drill bit on which they are mounted is in use down a borehole. It is found that as a result of such conditions delamination of the superhard facing table can occur, that is to say the separation and loss of the diamond or other superhard material over part or all of the front surface of the cutting element. The provision of a configured non-planar interface between the facing table and substrate, and the provision of a peripheral rim on the facing table, may reduce the tendency for delamination of the facing table to occur, but it is found that this can still sometimes occur with existing cutter interface configurations.

Studies have suggested that the impact loads which may result in delamination may be caused, at least in part, by torsional vibration of the drill string or by the phenomenon known as "bit whirl" where, if the borehole becomes slightly larger than the diameter of the drill bit, the bit may precess around the walls of the borehole in the opposite direction to the direction of drilling rotation of the bit.

Torsional vibration and bit whirl can both have the effect that cutters on the drill bit may momentarily be rotating backwards, i.e. in the reverse rotational direction to the normal forward direction of rotation of the drill bit during drilling. The effect of this reverse rotation on a PDC cutter may be to impose unusual loads on the cutter in directions which may increase the risk of delamination. Prior art designs of configured interface between the facing table and substrate of the cutting element may provide added strength against impact loads having components parallel to the front surface of the facing table and rearwardly parallel to the central axis of the cutting element. Normal impact loads imposed on the cutting element during forward rotation will generally have components in these two directions. However, existing designs provide little protection against impact loads having components in a forward direction with parallel to the central axis of the cutting element, that is to say in the direction of loads resulting from reverse rotation of the cutting element.

The present invention therefore sets out to provide an improved design of cutting element which may be, less susceptible to damage as a result of temporary backwards rotation of the cutting element.

SUMMARY OF THE INVENTION

According to a first aspect of the invention there is provided a configured interface between the facing table and substrate which is designed to render the bond between the facing table and substrate more resistant to loads resulting from backwards rotation of the cutting elements.

According to this aspect of the invention there is provided a preform cutting element, for a rotary drag-type drill bit, including a facing table of superhard material having a front face, a peripheral surface, and a rear surface bonded to the front surface of a substrate which is less hard than the facing table, the facing table having at least one locking portion projecting rearwardly from the rear surface of the facing table into the substrate, the locking portion and the substrate having interengaging formations whereby part of the substrate overlies at least one part of the locking portion.

Accordingly, with this arrangement, forces acting on the facing table tending to lift it from the front surface of the substrate are resisted by the portion of the substrate which overlies the part of the locking portion.

Said part of the locking portion may be spaced from the rear surface of the facing table, so that said portion of the substrate projects between the part of the locking portion and the rear surface of the facing table.

The facing table may extend across the whole of the front surface of the substrate, or across only a part of the front surface of the substrate, leaving another part of the front surface of the substrate exposed.

The locking portion may extend around at least a part of the periphery of the facing table. For example, it may extend around substantially the whole periphery of the facing table. In this case said inter-engaging formations may be provided between an inwardly facing surface of the locking portion and the adjacent surface of the substrate. Where the locking portion extends around only a part of the periphery of the facing table, it preferably extends around a part of the periphery adjacent the cutting edge of the facing table.

The cutting element may be generally circular or part-circular and in this case the locking portion may have an inner surface which extends across a chord of the facing table, or which is curved so as substantially to follow the curvature of the outer periphery of the facing table.

In any of the above arrangements said inter-engaging formations may include at least one projection on the locking portion which extends transversely to an axis extending at right angles to the front surface of the facing table.

Said locking portion is preferably elongate and in this case the projection may comprise a lateral flange extending longitudinally of the locking portion and spaced from the front surface of the substrate. There may be provided a plurality of such flanges on the locking portion spaced at different distances from the front surface of the substrate. The extremities of the flanges may lie on an imaginary surface extending generally at right angles to the front surface of the facing table. Alternatively, the imaginary surface may extend at less than a right angle to the front surface of the facing table.

In any of the above arrangements the locking portion and facing table may be formed with further inter-engaging formations which inter-engage as viewed in the general plane of the facing table. For example, the locking portion and facing table may be formed with inter-engaging projections and recesses as viewed in the general plane of the facing table. In the case where the locking portion is elongate, for example extends around a part of the periphery of the facing table, said further inter-engaging projections and recesses may be formed at opposite ends of the locking portion.

In any of the above arrangements the substrate may be formed in two or more parts, including a subsidiary part abutting said locking portion which is of a different composition from a main part of the substrate. For example, said subsidiary part of the substrate may have a lower coefficient of thermal expansion than the main part of the substrate.

The subsidiary part of the substrate may extend across the whole of the rear surface of the facing table, other than that part of the rear surface from which the locking portion extends, and also extends rearwardly from said surface to at least the rearward extremity of the locking portion.

In one particular embodiment the subsidiary part extends rearwardly beyond the rearmost extremity of the locking portion and into the main part of the substrate. For example, the subsidiary part may extend completely through the main part of the substrate to the rearmost surface thereof.

According to a second aspect of the invention, the cutting element is rendered less susceptible to damage through backwards rotation by appropriate shaping of the peripheral surface of the facing table.

According to this aspect of the invention there is provided a preform cutting element, for a rotary drag-type drill bit, including a facing table of superhard material having a front face, a peripheral surface, and a rear surface bonded to the front surface of a substrate which is less hard than the facing table, the peripheral surface of the facing table being convexly curved, as viewed in cross-section, at least in the vicinity of the cutting edge of the facing table. In a preferred embodiment the peripheral surface is convexly curved around substantially the whole periphery of the facing table.

The convex curvature of the peripheral surface of the facing table tends to result in the periphery sliding or rolling smoothly over the surface of the formation being drilled should the cutting element momentarily rotate backwards, in the opposite direction to the normal forward cutting direction. This sliding or rolling action may reduce the forward components of impact forces on the facing table, thereby reducing the risk of delamination.

The periphery of the facing table may curve inwardly as it extends forwardly away from the substrate towards the front surface of the facing table, so that the facing table decreases in width in this direction. The convex periphery of the facing table may also curve inwardly as it extends rearwardly towards the substrate so that, at the rearmost edge of the periphery of the facing table, the substrate is of lesser width than the maximum width of the facing table. In this case the substrate may itself increase in width as it extends rearwardly from the rearmost edge of the of the periphery of the facing table. For example, the substrate may increase in width to an overall width which is substantially equal to the overall width of the facing table.

BRIEF DESCRIPTION OF THE DRAWINGS

FIG. 3 is a diagrammatic section through a prior art cutting element, mounted on a drill bit.

FIG. 4 is a diagrammatic section through one form of cutting element according to the present invention.

FIG. 5 is a similar view of an alternative embodiment.

FIG. 6 is a plan view of the cutting element of FIG. 5.

FIG. 7 is a plan view of a modified form of cutting element.

FIGS. 8–10 are diagrammatic sections through further cutting elements according to the invention.

FIG. 11 is a perspective view of a further cutting element according to the invention.

FIG. 12 is a plan view of the cutting element of FIG. 11.

FIG. 13 is a plan view of a modified version of the embodiment of FIGS. 11 and 12.

FIGS. 14–19 are diagrammatic sections through other cutting elements according to the present invention.

FIGS. 20–25 are plan and sectional views of further embodiments.

DETAILED DESCRIPTION OF THE PREFERRED EMBODIMENTS

Figure 1:
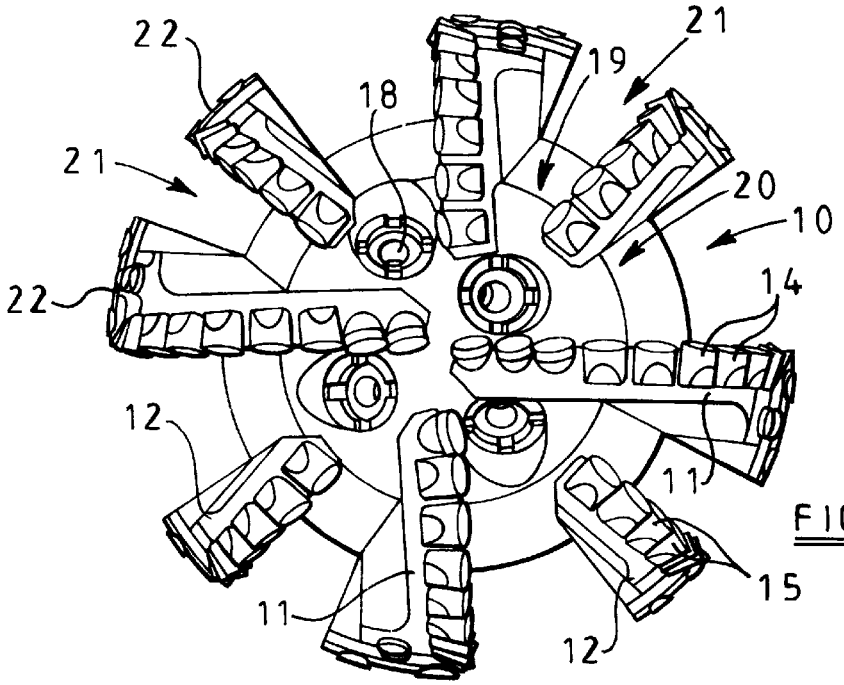
FIG. 1 is an end view of one form of rotary drill bit incorporating cutting elements according to the invention.
Figure 2:
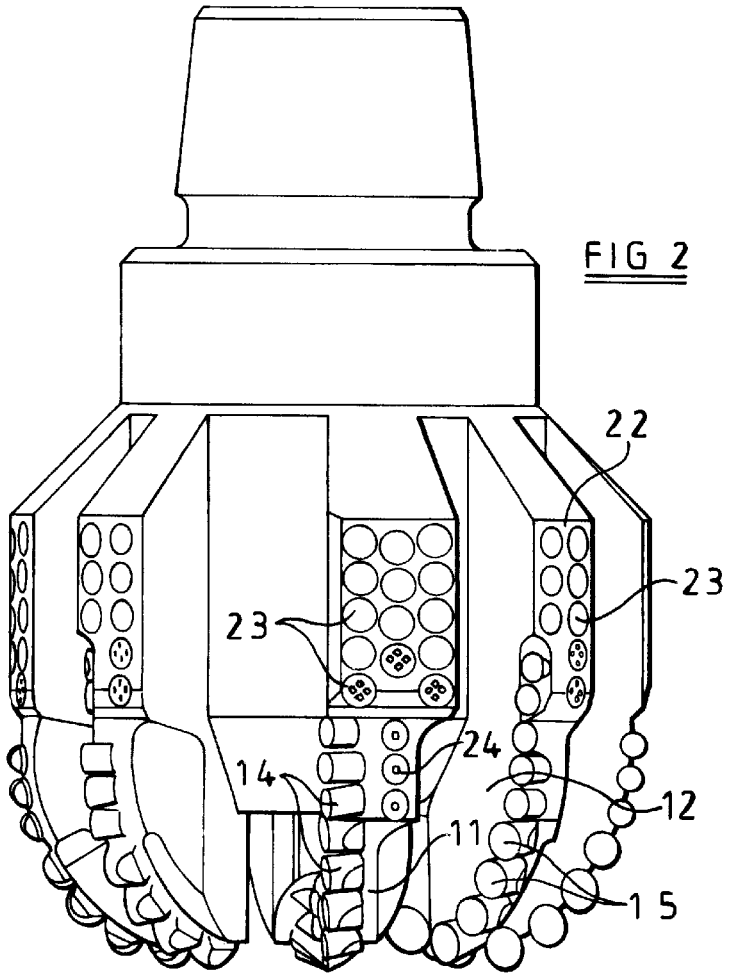
FIG. 2 is a side elevation of the drill bit of FIG. 1.

Referring to FIGS. 1 and 2, the drill bit comprises a bit body 10 on which are formed four primary blades 11 and four secondary blades 12. The blades extend generally radially with respect to the bit axis.

The leading edges of the secondary blades are substantially equally spaced with respect to one another, but the leading edge of each secondary blade is closer to its associated preceding primary blade than it is to the following primary blade.

Primary cutters 14 are spaced apart side-by-side along each primary blade 11 and secondary cutters 15 are spaced apart side-by-side along each secondary blade 12. Each secondary cutter 15 is located at the same radial distance from the bit axis as an associated one of the primary cutters on the preceding primary blade.

Each cutter 14, 15 is generally cylindrical and of circular cross-section and comprises a front facing table of polycrystalline diamond bonded to a cylindrical substrate of cemented tungsten carbide. Each cutter is received within a part-cylindrical pocket in its respective blade.

The primary cutters 14 are arranged in a generally spiral configuration over the drill bit so as to form a cutting profile which sweeps across the whole of the bottom of the borehole being drilled.

The three outermost cutters 14 on each primary blade 11 are provided, in known manner, with back-up studs 24 mounted on the same primary blade rearwardly of the primary cutters. The back-up studs may be in the form of cylindrical studs of tungsten carbide embedded with particles of synthetic or natural diamond.

The bit body 10 is formed with a central passage (not shown) which communicates through subsidiary passages with nozzles 18 mounted at the surface of the bit body. In known manner drilling fluid under pressure is delivered to the nozzles 18 through the internal passages and flows outwardly through the spaces 19, 20 between adjacent blades for cooling and cleaning the cutters. The spaces 19, 20 lead to junk slots 21 through which the drilling fluid flows upwardly through the annulus between the drill string and the surrounding formation. The junk slots 21 are separated by gauge pads 22 which bear against the side wall of the borehole and are formed with bearing or abrasion inserts 23.

The bit body and blades may be machined from metal, usually steel, which may be hardfaced. Alternatively the bit body, or a part thereof, maybe molded from matrix material using a powder metallurgy process. The methods of manufacturing drill bits of this general type are well known in the art and will not be described in detail.

FIG. 3 is a section through a prior art preform cutting element mounted on a rotary drag-type drill bit.

Referring to FIG. 3, a blade 25 on the bit body is formed with a cylindrical socket 26 in which is brazed a preform cutting element 27 comprising a front facing table 28 of polycrystalline diamond bonded to a cylindrical substrate 29 of cemented tungsten carbide.

In FIG. 3 the interface 30 between the facing table and substrate is shown as flat and planar although, as previously mentioned, it is well known to provide a configured non-planar interface in order to improve the bond between the facing table and substrate.

FIG. 3 shows the cutting element 27 traveling across the formation as is well known, as the drill bit rotates, to remove cuttings indicated diagrammatically at 32. During normal drilling an impact load on the cutting edge 33 of the cutting element 27 will normally have a vertical component (with respect to FIG. 3) and a rearward horizontal component, i.e. a component in the opposite direction to the normal forward direction of rotation of the cutting element, as indicated by the arrow 34. The direction of a typical normal impact load is indicated by the arrow 35. Where the interface 30 between the facing table and substrate is configured as in prior art arrangements, such configuration may improve the resistance of the cutting element to delamination of the facing table 28, or part thereof, as a result of such impact loads. It will be seen that a normal impact load, such as is indicated at 35, would tend to cause separation of the facing table 28 from the substrate 29 only by a shear force acting along the plane of the interface 30. Any form of configured interface would increase the resistance of the bond between the facing table and substrate to such a shear force.

However, if the direction of rotation of the cutting element 27 relative to the formation is temporarily or momentarily reversed, the direction of an impact force acting on the cutting edge 33 during such reverse rotation is different and it acts forwardly as indicated by the arrow 36. As a result, such an impact force has a component acting in the forward direction and therefore tending to "lift" the facing table 28 from the substrate 29, in addition to the shear force acting along the interface 30. It is therefore believed that the risk of delamination of the facing table 28 is much greater when reverse rotation occurs and the present invention provides arrangements for enabling the cutting element better to resist such delamination.

FIG. 4 is a cross-section through a circular cutting element according to the present invention. The cutting element comprises a facing table 37 of polycrystalline diamond bonded in a high pressure, high temperature press to a coaxial substrate 38 of cemented tungsten carbide. The facing table 37 is formed with a rearwardly projecting peripheral rim 39 which extends around the whole periphery of the facing table and is formed with an inwardly projecting flange 40 which is spaced from the rear surface 41 of the facing table 37 so that a portion 42 of the substrate 38 projects between the flange 40 and the rear surface 41.

As a result of this configuration, any tendency of the facing table 37 to be forced away from the substrate 38 by a force acting in the general direction indicated by the arrow 43 is resisted by the portion 42 of the substrate overlying the flange 40 of the facing table and prevent its separation from the substrate.

Instead of extending around the whole periphery of the facing table, the rearwardly extending rim on the facing table may extend around only that part of the periphery which is adjacent the cutting edge of the cutting element, and such an arrangement is shown in FIG. 5. Here the rim portion 44 on the facing table 45 extends around only a part of the periphery of the facing table in the vicinity of the cutting edge 46. Otherwise the cross-sectional shape of the rim 44 is similar to that shown in FIG. 4.

FIG. 6 is a plan view of the cutting element shown in FIG. 5 and it will be seen that in this instance the inner edge 47 of the peripheral rim 44 extends across a chord of the facing table 45. Alternatively, as shown in FIG. 7 the inner edge 48 of the rim may be curved so as substantially to follow the curvature of the cutting edge 49 of the element.

FIGS. 8–13 show further arrangements where the rim on the facing table extends around only part of the periphery of the facing table.

In the arrangement of FIG. 8 the rim 50 on the facing table 51 is formed with a number of spaced flanges 52A spaced apart at different distances from the rear surface of the facing table 51. This increases the interlocking between the rim and the substrate 52 and hence the resistance to forces tending to detach the facing table 51 from the substrate.

In the arrangement of FIG. 8 the inner edges of the flanges 52A lie on a surface which extends generally at right angles to the front surface of the facing table 51. FIG. 9 shows an alternative arrangement where the inwardly projecting flanges on the rim 53 are of different widths so that their inward edges lie on a surface which is inclined outwardly as it extends away from the facing table 54 at less than a right angle.

In the modified arrangement of FIG. 10 the inward edges of the flanges on the peripheral rim 55 lie on a surface which is inclined inwardly as it extends away from the facing table 56 at less than a right angle.

In any of the arrangements of FIGS. 5–10 the rearwardly extending rim on the facing table may be of any required peripheral extent. FIG. 11 shows an arrangement where the peripheral rim is of comparatively small peripheral extent and is essentially in the form of a tongue 57 extending from the rear of the facing table 58 into the substrate 59. The inwardly facing surface of the tongue 57, which is adjacent the cutting edge portion 60 of the cutting element, may be of any of the configurations shown in FIGS. 5–10 or indeed of any configuration according to the invention.

FIG. 12 is a plan view of the cutting element shown in FIG. 11 and shows the inner extremities of the tongue 57 being curvilinear in shape as indicated at 61. In a modified version shown in FIG. 13, the end edges of the tongue 57 are also configured in plan view, as indicated at 62, to provide an interlock between the ends of the tongue and the substrate. This further assists in retaining the lacing table 58 on the substrate 59 in a manner to inhibit delamination.

In any of the arrangements according to the invention the rear surface of the facing table from which the peripheral rim projects may be further configured to improve the bond between the facing table and the substrate. For example, the rear surface of the facing table and the abutting front surface of the substrate may be formed with inter-engaging projections and recesses.

In the arrangements described above the locking portion on the rear surface of the facing table is at the periphery of the facing table and substrate. However, the invention does not exclude arrangement, where the locking portion is spaced inwardly from the periphery. The inwardly located locking portion may be as an alternative or in addition to the peripheral rim.

It is believed that one of the factors contributing to the delamination of the facing table in prior art arrangements is the difference in coefficient of thermal expansion between the polycrystalline diamond or other superhard material of the facing table and the tungsten carbide or similar material of the substrate. In order to reduce this problem, it is common practice in preform cutting elements of the general type to which the invention relates for a transition layer to be provided between the substrate and facing table, the transition layer being, for example, formed from a material having a coefficient of thermal expansion intermediate that of the facing table and substrate. Such transition layer may be provided in any of the arrangements according to the present invention. FIGS. 14–16 show other arrangements for overcoming this thermal stress problem, particularly for use in arrangements according to the present invention.

In the embodiment of FIG. 14 the facing table 63 is of generally the same configuration as that shown in FIG. 4. However, the substrate 64 is formed in two parts indicated at 65 and 66 respectively. The part 65 is a plain disc on which the rearward extremities of the peripheral flange 67 rest while the second part 66 fills the space inwardly of the peripheral flange 67.

The larger piece 65 of the substrate may be of the standard form of cemented tungsten carbide used in such cutting elements, i.e. including a percentage of cobalt of 13% or higher. However, the portion 66 within the peripheral rim 67 has a lower cobalt content so as to reduce the coefficient of thermal expansion of the carbide. Alternatively, the portion 66 may be of tungsten composite, comprising tungsten metal and metal matrix, again lowering the coefficient of thermal expansion.

The diamond layer 63 and the two layers of different substrate material are bonded together in the high pressure, high temperature press in the usual way, although the formation of the substrate 64 in two pieces may also facilitate the manufacture of the element and particularly the packing of the diamond powder around the shaped periphery of the part 66.

Since the part 66 has a coefficient of thermal expansion which is nearer to that of the diamond than the main part 65 of the substrate, there is less thermally induced stress at the interface between the substrate and diamond layer than would be the case where the substrate is formed in one piece. It is not desirable to form the whole of the substrate from the reduced cobalt material from which the part 66 is formed, since reduction in cobalt content also reduces the toughness of the material.

In the modified arrangement shown in FIG. 15 the portion of the substrate of lower cobalt content and lower coefficient of thermal expansion extends rearwardly through the other part 68 of the substrate, as indicated at 69 in FIG. 15. In this case the outer periphery of the substrate is still provided by the tougher carbide of higher cobalt content.

Although this arrangement for reducing thermal stresses at the interface between the diamond and the substrate is particularly applicable to the present invention, it may also be more generally applied, and FIG. 16 shows another arrangement. In this case the diamond facing table 70 is formed with a plain peripheral rim 71 and the substrate comprises a central core 72, of low cobalt content and low coefficient of thermal expansion, which extends into the space within the rim 71. Rearwardly of the rim 71 the core 72 is surrounded by a sleeve 73 of tougher tungsten carbide of higher cobalt content.

As previously mentioned, the present invention also provides arrangements which reduce the effects of temporary backwards rotation of the cutting element by appropriate shaping of the outer periphery of the facing table.

In the arrangement of FIG. 17 the diamond facing table 74 has a peripheral rim 75 which is received within a circumferential rebate 76 formed around the tungsten carbide substrate 77. The outer surface 78 of the facing table and rim 75 is convexly curved inwardly as it extends from the substrate 77 towards the front face 79 of the facing table 74.

Should temporary reversal of the direction of rotation of the cutting element occur, the convexly curved periphery of the facing table causes the periphery to slip or roll over the formation so that the forward components of forces acting on the facing table are reduced, hence reducing their tendency to cause the facing table to delaminate. The arrangements shown in FIGS. 18 and 19 may have a similar effect.

In the arrangement of FIG. 18 the facing table 80 has an outer periphery 81 which is generally semi-circular as viewed in cross-section, the surface 81 sloping inwardly both as it extends towards the front surface 82 of the facing table and towards the substrate 83.

In the modified arrangement shown in FIG. 19 the outer periphery 84 of the facing table 85 is again semi-circular as viewed in cross-section, but in this case the outer surface 86 of the substrate 87 increases in diameter as it extends rearwardly from the rearward extremities of the peripheral rim 88 until it reaches the same overall diameter as the facing table 85.

In the arrangements of FIGS. 17–19 the inner surface of the peripheral rim on the facing table is shown as generally cylindrical or inwardly curved and it is not therefore in accordance with the first aspect of the present invention. However, it will be appreciated that the curved configuration of the outer surface of the peripheral rim may be employed in any of the arrangements of FIGS. 4–15, and indeed to any other arrangement according to the first aspect of the invention.

In the arrangements of FIGS. 4–15 above, the locking portion on the facing table of the cutting element extends around part or all of the periphery of the facing table and the inter-engaging formations are provided between an inwardly facing surface of the locking portion and the adjacent surface of the substrate. However, this is not essential to the invention and arrangements are possible where at least a part of the locking portion is spaced inwardly from the periphery of the facing table and the inter-engaging formations are provided between an outwardly facing surface of the locking portion and the adjacent surface of the substrate. Arrangements of this type are shown, by way of example, in FIGS. 20–23.

In the arrangement of FIGS. 20 and 21 the circular and generally cylindrical cutting element comprises a facing table 90 of polycrystalline diamond bonded in a high pressure, high temperature press to a coaxial substrate 91 of cemented tungsten carbide. The facing table 90 is formed with a single part-circular rearward projection 92 a part 93 of which extends along the periphery of the facing table in the vicinity of the cutting edge and the remainder of which is spaced inwardly from the periphery of the facing table.

The outer surface of the projection 92, where it lies within the substrate 91, is formed with an outwardly projecting flange 94 which is spaced from the rear surface 95 of the facing table 90 so that a portion 96 of the substrate 91 projects inwardly between the flange 94 and the rear surface 95.

As in the previously described arrangements, any tendency of the facing table 90 to be forced away from the substrate 91 is resisted by the portion 96 of the substrate overlying the flange 94 of the facing tab Le and prevents its separation from the substrate.

In the arrangement of FIGS. 20 and 21, the facing table extends over the whole of the front surface of the substrate. However, this is not essential, and FIGS. 22 and 23 show a modification where the part-circular facing table 97 extends across only a part of the upper surface of the substrate 98 so that a large proportion of the upper surface 99 of the substrate 98 is exposed and forms the front face of the cutting element around the facing table 97.

In this case the facing table 97 is formed with a single rearward projection 100 which extends across the whole area of the facing table 97 and also provides an outwardly projecting flange 101 around that part of the periphery of the projection 100 which does not lie along the outer periphery of the cutting element. In this arrangement also, a portion 102 of the substrate material projects inwardly to overlie the flange 101 on the projection 100 on the facing table, and thus inhibits separation of the facing table 97 from the substrate 98.

FIGS. 24 and 25 show a further modification where the facing table 103 extends across the whole of the front surface of the substrate 104. The facing table 103, instead of being provided with a continuous peripheral rim, is provided with a plurality of generally semi-circular projections 105 spaced apart around the periphery of the cutting element. Each projection 105 is formed with a flange 106 which projects inwardly away from the periphery of the cutting element and is spaced from the rear surface 107 of the facing table 103 so that a portion 108 of the substrate 104 projects between the flange and the rear surface of the facing table.

As in previous arrangements, the fact that portions 108 of the substrate overlie the flanges 106 on the projections 105 resists separation of the facing table from the substrate. However, by providing separate peripheral projections instead of a continuous peripheral rim, the total length of the flanges 106 may be greater than the overall length of a continuous flange on a peripheral rim, so that, by suitably choosing the size and configuration of the projections 105 arrangements of the general kind shown in FIGS. 24 and 25 may enhance the attachment of the facing table to the substrate.

Whereas the present invention has been described in particular relation to the drawings attached hereto, it should be understood that other and further modifications, apart from those shown or suggested herein, may be made within the scope and spirit of the present invention.

What is claimed:

1. A preform cutting element, for a rotary drag-type drill bit, including a facing table of superhard material having a front face, a peripheral surface, and a rear surface bonded to the front surface of a substrate which is less hard than the facing table, the facing table having at least one locking portion projecting rearwardly from the rear surface of the facing table into the substrate, the locking portion and the substrate having interengaging formations whereby part of the substrate overlies at least one part of the locking portion, and wherein the locking portion extends around only a part of the periphery of the facing table, and extends around a part of the periphery adjacent the cutting edge of the facing table.

2. A preform element according to claim 1, wherein said part of the locking portion is spaced from the rear surface of the facing table, so that said portion of the substrate projects between the part of the locking portion and the rear surface of the facing table.

3. A preform element according to claim 1, wherein the facing table extends across the whole of the front surface of the substrate.

4. A preform element according to claim 1, wherein the facing table extends across only a part of the front surface of the substrate, leaving another part of the front surface of the substrate exposed.

5. A preform element according to claim 1, wherein the cutting element is at least partially circular and the locking portion has an inner surface which extends across a chord of the facing table.

6. A preform element according to claim 1, wherein the cutting element is at least partially circular and the locking portion has an inner surface which is curved so as substantially to follow the curvature of the outer periphery of the facing table.

7. A preform element according to claim 1, wherein said inter-engaging formations include at least one projection on the locking portion which extends transversely to an axis extending at right angles to the front surface of the facing table.

8. A preform element according to claim 7, wherein said locking portion is elongate and the projection comprises a lateral flange extending longitudinally of the locking portion and spaced from the front surface of the substrate.

9. A preform cutting element, for a rotary drag-type drill bit, including a facing table of superhard material having a front face, a peripheral surface, and a rear surface bonded to the front surface of a substrate which is less hard than the facing table, the facing table having at least one locking portion projecting rearwardly from the rear surface of the facing table into the substrate, the locking portion and the substrate having interengaging formations whereby part of the substrate overlies at least one part of the locking portion, wherein said inter-engaging formations include at least one projection on the locking portion which extends transversely to an axis extending at right angles to the front surface of the facing table, wherein said locking portion is elongate and the projection comprises a lateral flange extending longitudinally of the locking portion and spaced from the front surface of the substrate and, wherein there are provided a plurality of lateral flanges on the locking portion spaced at different distances from the front surface of the substrate.

10. A preform element according to claim 9, wherein the extremities of the flanges lie on an imaginary surface extending generally at right angles to the front surface of the facing table.

11. A preform element according to claim 9, wherein the extremities of the flanges lie on an imaginary surface extending at less than a right angle to the front surface of the facing table.

12. A preform cutting element, for a rotary drag-type drill bit, including a facing table of superhard material having a front face, a peripheral surface, and a rear surface bonded to the front surface of a substrate which is less hard than the facing table, the facing table having at least one locking portion projecting rearwardly from the rear surface of the facing table into the substrate, the locking portion and the substrate having interengaging formations whereby part of the substrate overlies at least one part of the locking portion, wherein the locking portion and facing table are formed with further inter-engaging formations which inter-engage as viewed in the general plane of the facing table.

13. A preform element according to claim 12, wherein the locking portion extends around at least a part of the periphery of the facing table.

14. A perform element according to claim 12, wherein the locking portion extended around substantially the whole periphery of the facing table.

15. A preform element according to claim 14, wherein said inter-engaging formations are provided between an inwardly facing surface of the locking portion and the adjacent surface of the substrate.

16. A preform element according to claim 12, wherein the locking portion and facing table are formed with inter-engaging projections and recesses as viewed in the general plane of the facing table.

17. A preform element according to claim 16, wherein the locking portion is elongate and said further inter-engaging projections and recesses are formed at opposite ends of the locking portion.

18. A preform element according to claim 12, wherein said part of the locking portion is spaced from the rear surface of the facing table, so that said portion of the substrate projects between the part of the locking portion and the rear surface of the facing table.

19. A preform element according to claim 12, wherein the facing table extends across the whole of the front surface of the substrate.

20. A preform element according to claim 12, wherein the facing table extends across only a part of the front surface of the substrate, leaving another part of the front surface of the substrate exposed.

21. A preform cutting element, for a rotary drag-type drill bit, including a facing table of superhard material having a front face, a peripheral surface, and a rear surface bonded to the front surface of a substrate which is less hard than the facing table, the facing table having at least one locking portion projecting rearwardly from the rear surface of the facing table into the substrate, the locking portion and the substrate having interengaging formations whereby part of the substrate overlies at least one part of the locking portion, wherein the substrate is formed in at least two parts, including a subsidiary part abutting said locking portion which is of a different composition from a main part of the substrate, and wherein the subsidiary part of the substrate extends across the whole of the rear surface of the facing table, other than that part of the rear surface from which the locking portion extends, and also extends rearwardly from said surface to at least the rearward extremity of the locking portion.

22. A preform cutting element, for a rotary drag-type drill bit, including a facing table of superhard material having a front face, a peripheral surface, and a rear surface bonded to the front surface of a substrate which is less hard than the facing table, the facing table having at least one locking portion projecting rearwardly from the rear surface of the facing table into the substrate, the locking portion and the substrate having interengaging formations whereby part of the substrate overlies at least one part of the locking portion, wherein the substrate is formed in at least two parts, including a subsidiary part abutting said locking portion which is of a different composition from a main part of the substrate, and wherein the subsidiary part of the substrate extends rearwardly beyond the rearmost extremity of the locking portion and into the main part of the substrate.

23. A preform element according to claim 22, wherein the subsidiary part of the substrate extends completely through the main part of the substrate to the rearmost surface thereof.

24. A preform cutting element, for a rotary drag-type drill bit, including a facing table of superhard material having a front face, a peripheral surface, and a rear surface bonded to the front surface of a substrate which is less hard than the facing table, the peripheral surface of the facing table being convexly curved, as viewed in cross-section, at least in the vicinity of the cutting edge of the facing table, wherein the convex periphery of the facing table curves inwardly as it extends rearwardly towards the substrate so that, at the rearmost edge of the periphery of the facing table, the substrate is of lesser width than the maximum width of the facing table.

25. A preform element according to claim 24, wherein the peripheral surface of the facing table is convexly curved around substantially the whole periphery of the facing table.

26. A preform element according to claim 24, wherein the substrate increases in width as it extends rearwardly from the rearmost edge of the of the periphery of the facing table.

27. A preform element according to claim 26, wherein the substrate increases in width to an overall width which is substantially equal to the overall width of the facing table.

* * * * *